US011491479B2

(12) United States Patent
Winter

(10) Patent No.: US 11,491,479 B2
(45) Date of Patent: Nov. 8, 2022

(54) LABORATORY GLASSWARE AND ASSOCIATED METHODS FOR USING THE SAME

(71) Applicant: Rolf Winter, Portland, OR (US)

(72) Inventor: Rolf Winter, Portland, OR (US)

( * ) Notice: Subject to any disclaimer, the term of this patent is extended or adjusted under 35 U.S.C. 154(b) by 93 days.

(21) Appl. No.: 16/749,122

(22) Filed: Jan. 22, 2020

(65) Prior Publication Data

US 2021/0220816 A1 Jul. 22, 2021

(51) Int. Cl.
*B01L 3/08* (2006.01)

(52) U.S. Cl.
CPC ..... *B01L 3/08* (2013.01)

(58) Field of Classification Search
CPC ..... B01L 3/08
See application file for complete search history.

(56) References Cited

U.S. PATENT DOCUMENTS

| | | | | |
|---|---|---|---|---|
| 2,539,082 | A | 1/1951 | Hustinx | |
| 3,257,170 | A | 6/1966 | Marcus et al. | |
| 3,744,656 | A | 7/1973 | Wolfram | |
| 3,927,342 | A | 12/1975 | Bode et al. | |
| 4,072,243 | A | 2/1978 | Conant et al. | |
| 4,770,854 | A | 9/1988 | Lyman | |
| D307,869 | S | 5/1990 | Miskinis | |
| D312,128 | S | 11/1990 | Headley | |
| 5,178,817 | A | 1/1993 | Yamada et al. | |
| 5,271,085 | A | 12/1993 | Carballo | |
| 5,382,409 | A * | 1/1995 | Baxter | B01L 3/5082 220/732 |
| 5,478,478 | A | 12/1995 | Griswold | |
| 5,823,391 | A | 10/1998 | Klauke et al. | |
| 5,931,323 | A | 8/1999 | Wilkinson et al. | |
| 6,006,960 | A | 12/1999 | Gross | |
| 6,557,351 | B1 | 5/2003 | Ghedini et al. | |
| 2005/0132780 | A1 | 6/2005 | Keen | |
| 2012/0107196 | A1 | 5/2012 | Perlman | |
| 2013/0078735 | A1 * | 3/2013 | Sandra | G01N 1/34 436/175 |

(Continued)

FOREIGN PATENT DOCUMENTS

| | | | |
|---|---|---|---|
| CN | 202860148 U | * | 4/2013 |
| CN | 208642697 U | * | 3/2019 |

OTHER PUBLICATIONS

Machine-generated English translation of CN-202860148U (Apr. 2013).*

*Primary Examiner* — P. Kathryn Wright
(74) *Attorney, Agent, or Firm* — King & Partners, PLC

(57) ABSTRACT

A laboratory flask for use in association with a laboratory heating block, having: a flask body, wherein the flask body includes an upper portion, a lower portion, and a sidewall, wherein the sidewall of the flask body includes an inner surface, and an outer surface; a neck, wherein the neck includes an upper portion, a lower portion, and a sidewall, wherein the sidewall of the neck includes an inner surface, and an outer surface, and wherein the neck emanates contiguously from the flask body; and a reservoir, wherein the reservoir includes an upper portion, a lower portion, a bottom wall, and a sidewall, wherein the sidewall of the reservoir includes an inner surface, and an outer surface, and wherein the reservoir is adapted for releasable securement within a laboratory heating block.

2 Claims, 6 Drawing Sheets

(56) References Cited

U.S. PATENT DOCUMENTS

| | | | | |
|---|---|---|---|---|
| 2013/0125673 | A1* | 5/2013 | Kanipayor | G01N 1/42 73/863.11 |
| 2019/0112567 | A1 | 4/2019 | Scibek et al. | |
| 2019/0127674 | A1 | 5/2019 | Lacey | |

* cited by examiner

LABORATORY GLASSWARE AND ASSOCIATED METHODS FOR USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to laboratory glassware including, but not limited to, single-neck flasks, multi-neck flasks, reaction vessels, etcetera, that include a reservoir adapted for releasable securement within a laboratory heating block. The laboratory glassware of the present invention reduce the incidence of accidental spillage of contents contained within the flask body of the glassware when associated with a laboratory heating block, relative to traditional round bottom flasks. The laboratory glassware of the present invention also reduce and/or eliminate sediment rings on the inner surface of the flask body that accumulate during traditional agitation. The laboratory glassware of the present invention yet also facilitate efficient heat transfer from a laboratory heating block. Additionally, the laboratory glassware of the present invention enable the extended use of heating blocks/mantles for large volume reactions.

2. Background Art

Laboratory glassware (e.g., beakers, flasks, bottles, tubes, measuring tools, etcetera) has been known in the art for years, and are the subject of a plurality of patents including, for example: U.S. Pat. No. 6,006,960 entitled "Dispensing Structure Which Has a Lid with a Pressure-Openable Valve," U.S. Pat. No. 5,931,323 entitled "Sealed Container," U.S. Pat. No. 5,823,391 entitled "Dual Chamber Flexible Tube Dispensing Package and Method of Making," U.S. Pat. No. 5,178,817 entitled "Stretch Blow Molding Method for Manufacturing an Expanded Bottle," U.S. Pat. No. 4,770,854 entitled "Laboratory Flask," U.S. Pat. No. 4,072,243 entitled "Metal Coated Brittle Containers, Conduits and Other Objects for Laboratory and Industry," U.S. Pat. No. 3,927,342 entitled "Capillary Tube Gas Discharge Device," U.S. Pat. No. 3,744,656 entitled "Container," United States Patent Application Publication Number 2019/0112567 entitled "Vessels and Spinner Flasks with Reduced Impeller Wobble for Culturing Cells," and United States Patent Application Publication Number 2005/0132780 entitled "Viscometer Tube"—all of which are hereby incorporated herein by reference in their entirety including all references cited therein.

U.S. Pat. No. 6,006,960 appears to disclose a dispensing structure for discharging the contents from the interior of a container. The structure includes a body for extending from the container. The body defines a dispensing opening and a sealing surface around the dispensing opening. A lid is provided for movement between open and closed positions. The lid has a frame defining a lid dispensing passage through the lid. The lid has a sealing member for sealingly engaging the body sealing surface when the lid is in the closed position. The lid includes a flexible valve that is disposed within the lid frame across the lid dispensing passage. The flexible valve has self-sealing slits which open to permit flow therethrough in response to increased pressure on the side of the valve facing the container when the lid is closed.

U.S. Pat. No. 5,931,323 appears to disclose a sealed container that includes a base for containing a substance and a removable lid for closing and sealing the base. The base includes a bottom wall, a side enclosure extending upwardly from the bottom wall having an upper portion with a screw thread, and an upper wall extending inwardly and upwardly from the upper portion of the side enclosure having a circular brim which defines a wide mouth opening for the base. The removable lid includes a top wall and an encircling member extending downwardly therefrom with a screw thread which matingly engages with the screw thread of the upper wall of the base. For sealing with the base, the removable lid also includes a circular projection extending downwardly from the lid which engages and seals with the circular brim. For additional sealing, the removable lid further includes a circular flexible flange extending downwardly from the lid having a tip which is radially flexed relative to a remainder of the flange upon engagement with the upper wall of the jar to seal therewith as the circular projection and circular brim matingly engage.

U.S. Pat. No. 5,823,391 appears to disclose a dual chamber flexible tube dispensing package which is formed by providing a pair of plastic parisons, blow molding each parison to form a tube having a rigid finish, a shoulder adjacent the finish and a flexible body extending from the shoulder with a closed lower end; each tube having a generally D-shaped cross section throughout the finish, shoulder and body; each tube having an arcuate wall and a generally flat wall; and bringing the flat walls into abutting relationship. Each tube has a thread such that when the flat walls are in abutting relation, the thread on one tube form continuous thread with the thread of the other tube. In another form of dual chamber dispensing package, each tube has a plurality of vertically spaced integral ribs which extend transversely. The ribs on one tube are staggered relative to the ribs on the other tube so that when the tubes are brought into engagement, the ribs on one tube engage the ribs on the other tube and the shoulders are in abutment.

U.S. Pat. No. 5,178,817 appears to disclose a stretched bottle that has an inclined mouth portion. The bottle is formed in a manner that a straight parison is set in a blow mold having an inclined cavity to be stretched by a stretching rod during an air-blow operation or that a curved parison is set in the blow mold to be stretched by air-blow. The parison is curved or deformed by a defining mold or a pushing bar.

U.S. Pat. No. 4,770,854 appears to disclose a laboratory flask that includes a body and a canted neck at one end joined to the main surface by an inclined ramp. The neck diameter is maximized and along with the ramp allows the user excellent accessibility to the four corners of the flask end wall with a pipette and to the four corners of the growing surface with a scraper.

U.S. Pat. No. 4,072,243 appears to disclose improved metal coated glassware and other brittle, non-metallic engineering materials, including items for laboratory and industry, which items are ordinarily brittle and subject to breakage or rupture under relatively low pressures and relatively minor impacts, utilizing an anti-bonding film, such as graphite, between the external surface of the glass, and a metal coating, which is generally chemically vapor deposited. The coated products have good impact strength, shock resistance, good heat distribution, good pressure capability, and an extremely high safety factor. Brittle fracture or rupture is defined as a fracture unaccompanied by plastic or permanent deformation. Brittleness is defined as a quality or property of a material that leads to crack propagation without plastic deformation.

U.S. Pat. No. 3,927,342 appears to disclose methods of making complex glass panel structures having precision dimensions. Glass tubes, rods, plates or other large glass structures are redrawn individually or in groups to filamentary or capillary size tube or gas continuums which are assembled as a monolayer to form a gas discharge panel, for example. Complex glass structures having precision uniform cross-sectional dimensions are constructed. Various novel glass structures and/or conductor configurations and methods of assembling are also disclosed.

U.S. Pat. No. 3,744,656 appears to disclose a hollow blow-molded container that has injection molded inserts for handles and a reinforcing outlet ring. The inner face of the inserts are provided with a plurality of raised portions, such as small cones or parallel fluting, which pierce but do not fully penetrate the adjacent container wall.

United States Patent Application Publication Number 2019/0112567 appears to disclose a vessel that includes a body having a top portion, a bottom portion comprising a bottom interior surface, and a cylindrical sidewall. The vessel additionally has an impeller assembly inside the vessel body having a top portion rotatably coupled to the top portion of the vessel body, the impeller assembly having a plurality of planar blades, a central axis, a flexible shaft extending down from the top portion of the impeller assembly, a magnet receptacle molded within the plurality of planar blades, a magnet within the magnet receptacle, and an impeller o-ring coupled to a bottom surface of the planar blades. The vessel also includes a plurality of positioning nubs coupled to the bottom interior surface of the vessel body, spaced from an inside edge of the impeller o-ring.

United States Patent Application Publication Number 2005/0132780 appears to disclose a viscometer tube that includes a tubular body divided into three sections: an upper feed section, a lower capillary section and an intermediate transition section providing a transition between the upper feed section and the lower capillary section. Liquid flows from the upper feed section to the intermediate transition section and then to the lower capillary section. The upper feed section intersects the intermediate transition section either laterally or from below. An upper remote end of the intermediate transition section is open to atmosphere.

While the above-identified patents and/or publications appear to disclose various types of laboratory glassware, their configurations remain non-desirous and/or problematic inasmuch as, among other things, none of the above-identified laboratory glassware appear to include a reservoir adapted for releasable securement within a laboratory heating block, that, in turn, reduces and/or eliminates the incidence of accidental spillage of contents contained within the flask body. Moreover, none of the above-identified pieces of laboratory glassware reduce and/or eliminate sediment rings on the inner surface of the flask body that accumulate during traditional agitation. Furthermore, none of the above-identified pieces of laboratory glassware facilitate efficient heat transfer from a laboratory heating block.

These and other objects of the present invention will become apparent in light of the present specification, claims, and drawings.

SUMMARY OF THE INVENTION

The present invention is directed to a laboratory flask for use in association with a laboratory heating block, comprising: (a) a flask body, wherein the flask body includes an upper portion, a lower portion, and a sidewall, wherein the sidewall of the flask body includes an inner surface, and an outer surface; (b) a neck, wherein the neck includes an upper portion, a lower portion, and a sidewall, wherein the sidewall of the neck includes an inner surface, and an outer surface, and wherein the neck emanates contiguously from the flask body; and (c) a reservoir, wherein the reservoir includes an upper portion, a lower portion, a bottom wall, and a sidewall, wherein the sidewall of the reservoir includes an inner surface, and an outer surface, and wherein the reservoir is adapted for releasable securement within a laboratory heating block.

In a preferred embodiment of the present invention, the flask body comprises a generally spherical and/or cylindrical sidewall.

In another preferred embodiment of the present invention, the neck comprises a generally cylindrical and/or generally annular sidewall (e.g., non-tapered, tapered, etcetera).

In yet another preferred embodiment of the present invention, the neck is positioned above the flask body.

In one aspect of the present invention, the neck comprises an aperture for receiving a stopper, an adapter, a connector, and/or an additional piece of glassware.

In a preferred embodiment of the present invention, the reservoir comprises a generally cylindrical and/or annular sidewall.

In another preferred embodiment of the present invention, the reservoir is positioned below the flask body.

In yet another preferred embodiment of the present invention, the bottom wall of the reservoir is planar and/or non-planar (e.g., rounded).

In a preferred embodiment of the present invention, the sidewall of the reservoir comprises a diameter that is slightly less than the diameter of a sidewall of an associated laboratory heating block.

In another preferred embodiment of the present invention, the sidewall and the bottom wall of the reservoir comprise an outer peripheral geometry that is slightly less than the corresponding sidewall and bottom wall of an associated laboratory heating block. In this embodiment, the laboratory glassware of the present invention facilitates efficient heat transfer from a laboratory heating block.

The present invention is also directed to a laboratory flask for use in association with a laboratory heating block, consisting of: (a) a flask body, wherein the flask body includes an upper portion, a lower portion, and a sidewall, wherein the sidewall of the flask body includes an inner surface, an outer surface, and is spherical; (b) a neck positioned above the flask body, wherein the neck includes an aperture, an upper portion, a lower portion, and a sidewall, wherein the sidewall of the neck includes an inner surface, an outer surface, and is cylindrical; and (c) a reservoir positioned below the flask body, wherein the reservoir includes an upper portion, a lower portion, a bottom wall, and a sidewall, wherein the sidewall of the reservoir includes an inner surface, and an outer surface, and wherein the reservoir is adapted for releasable securement within a laboratory heating block.

The present invention is yet further directed to a process for using a laboratory flask with a laboratory heating block, comprising the steps of: (a) providing a laboratory heating block; (b) providing a laboratory flask, comprising: (1) a flask body, wherein the flask body includes an upper portion, a lower portion, and a sidewall, wherein the sidewall of the flask body includes an inner surface, and an outer surface; (2) a neck, wherein the neck includes an upper portion, a lower portion, and a sidewall, wherein the sidewall of the neck includes an inner surface, and an outer surface, and wherein the neck emanates contiguously from the flask body; and (3) a reservoir, wherein the reservoir includes an upper portion, a lower portion, a bottom wall, and a sidewall, wherein the sidewall of the reservoir includes an inner surface, and an outer surface, and wherein the reservoir is adapted for releasable securement within a laboratory heating block; (c) associating the laboratory flask with the laboratory heating block; and (d) preventing the laboratory flask from substantially tilting relative to the laboratory heating block.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
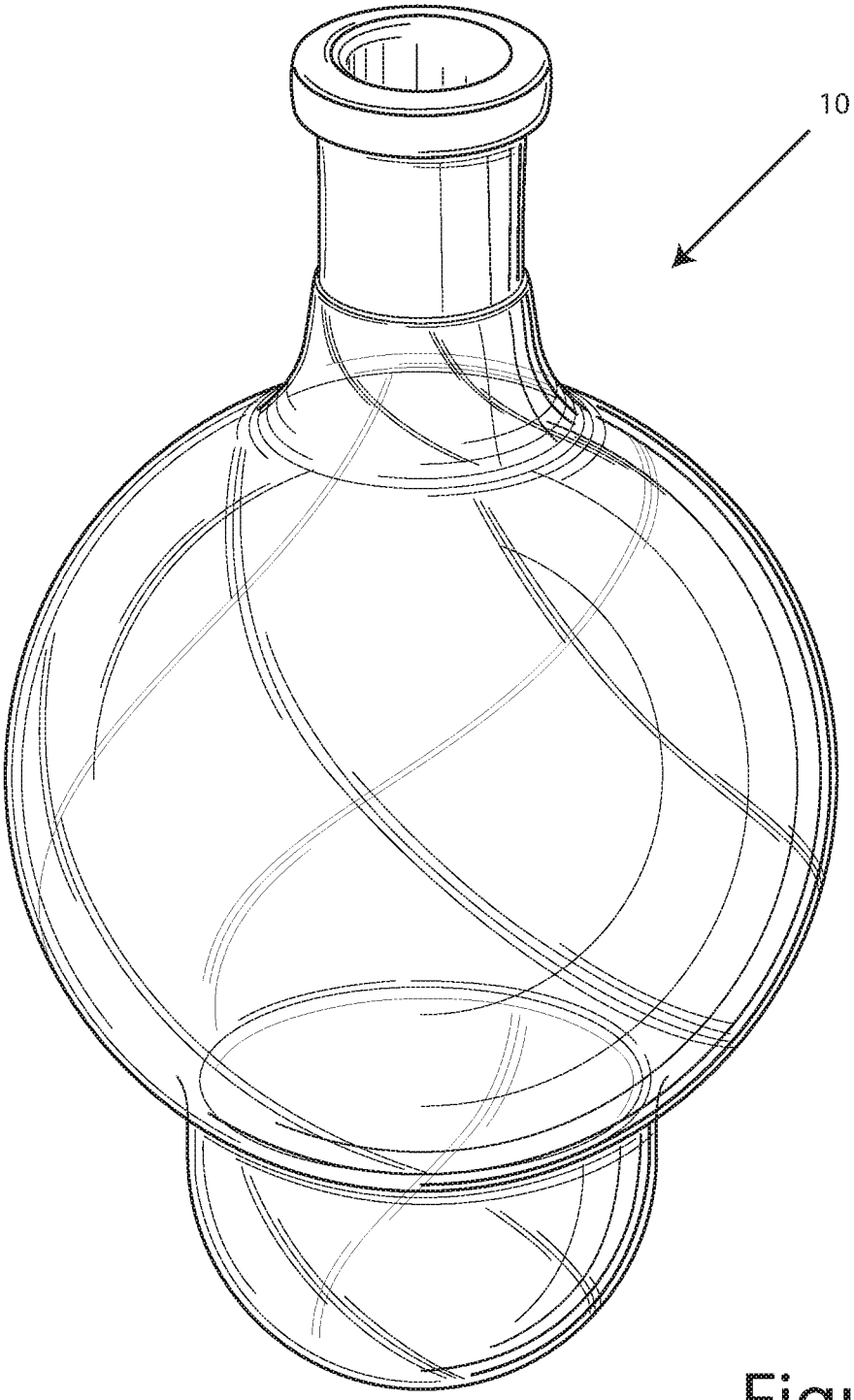
Figure 2:
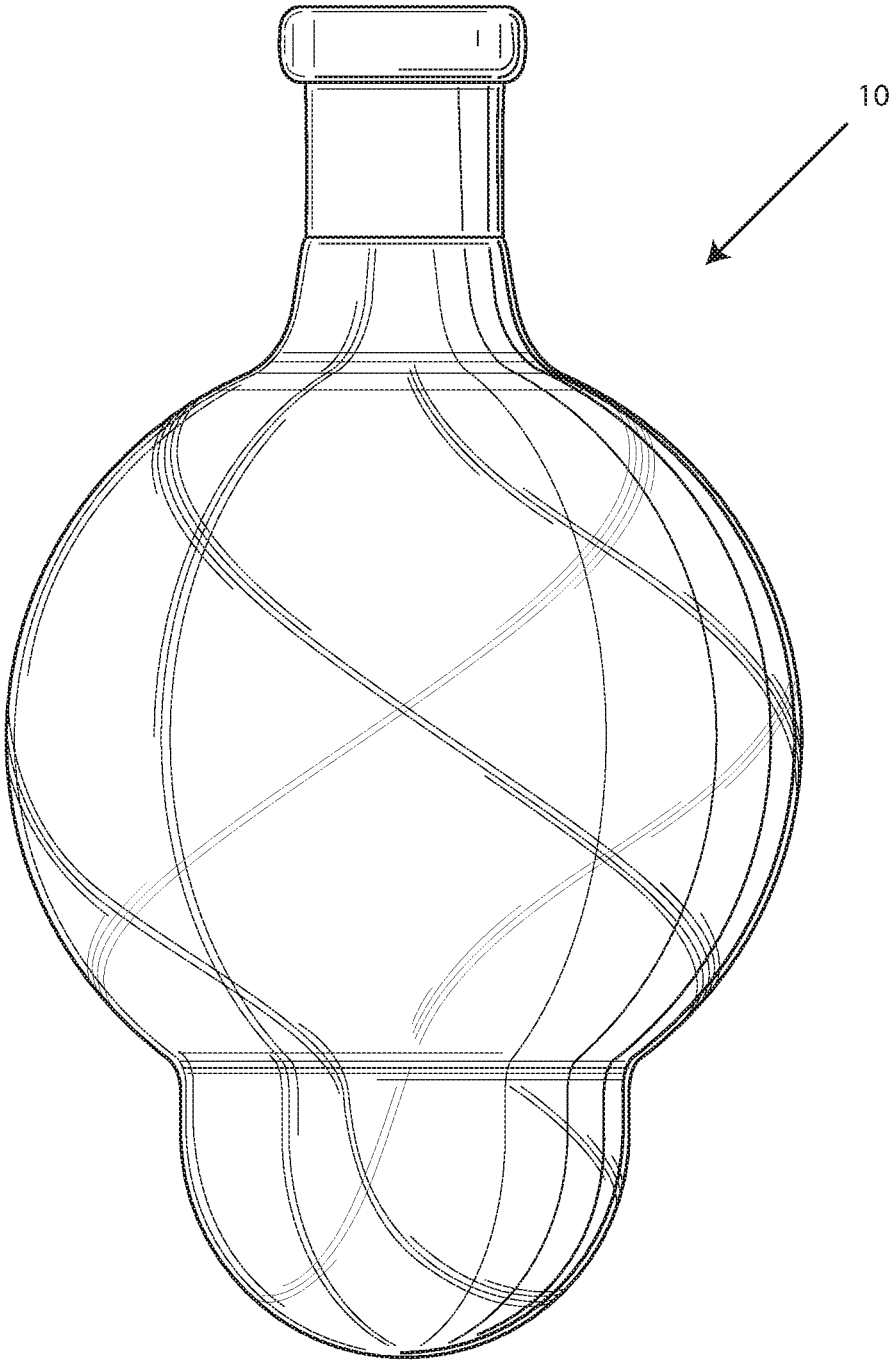
Figure 3:
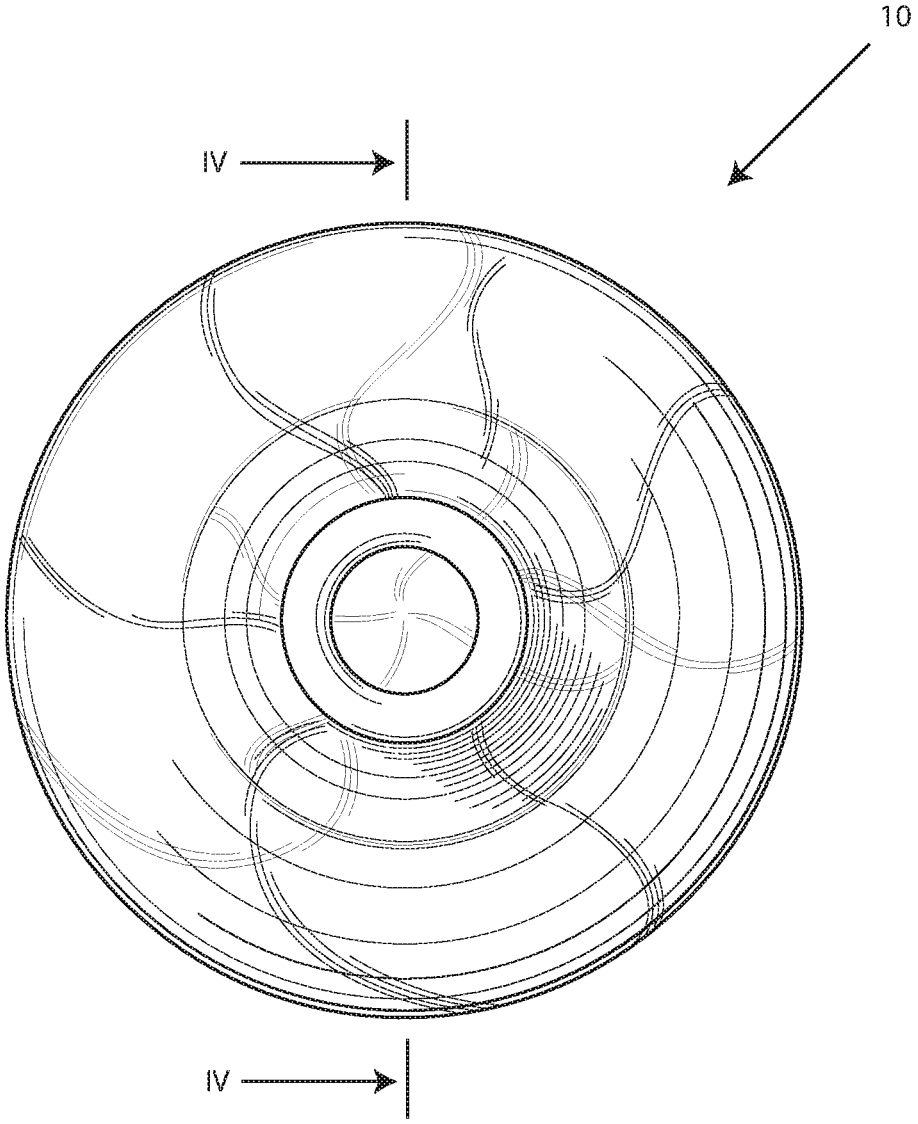
Figure 4:
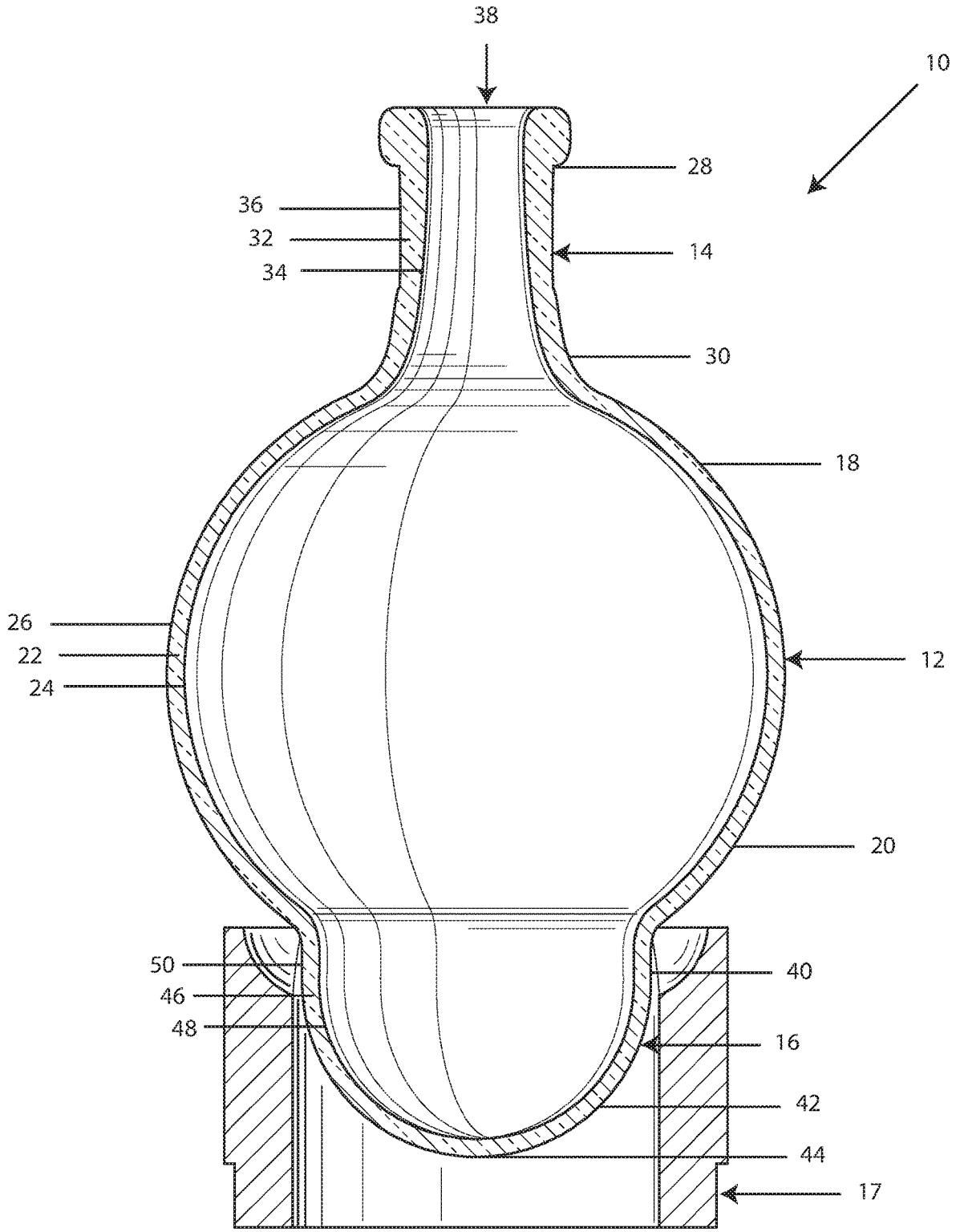
Figure 5:
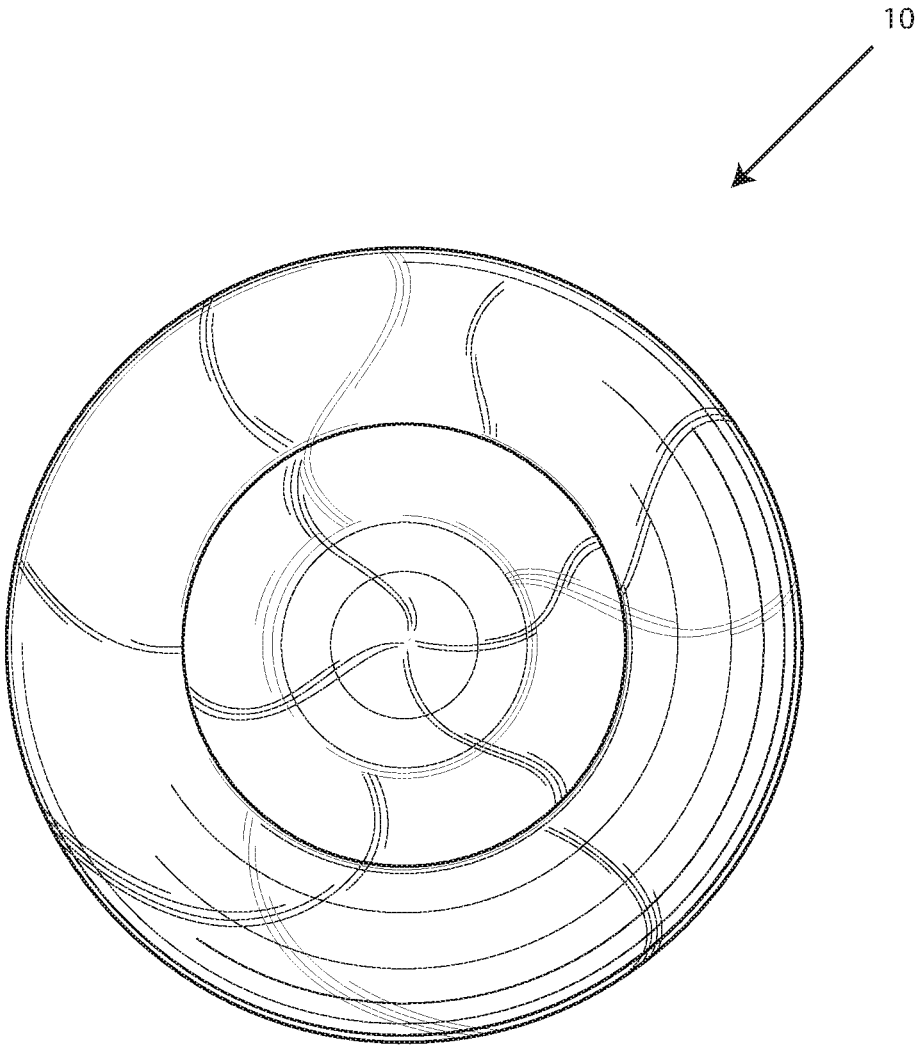
Figure 6:
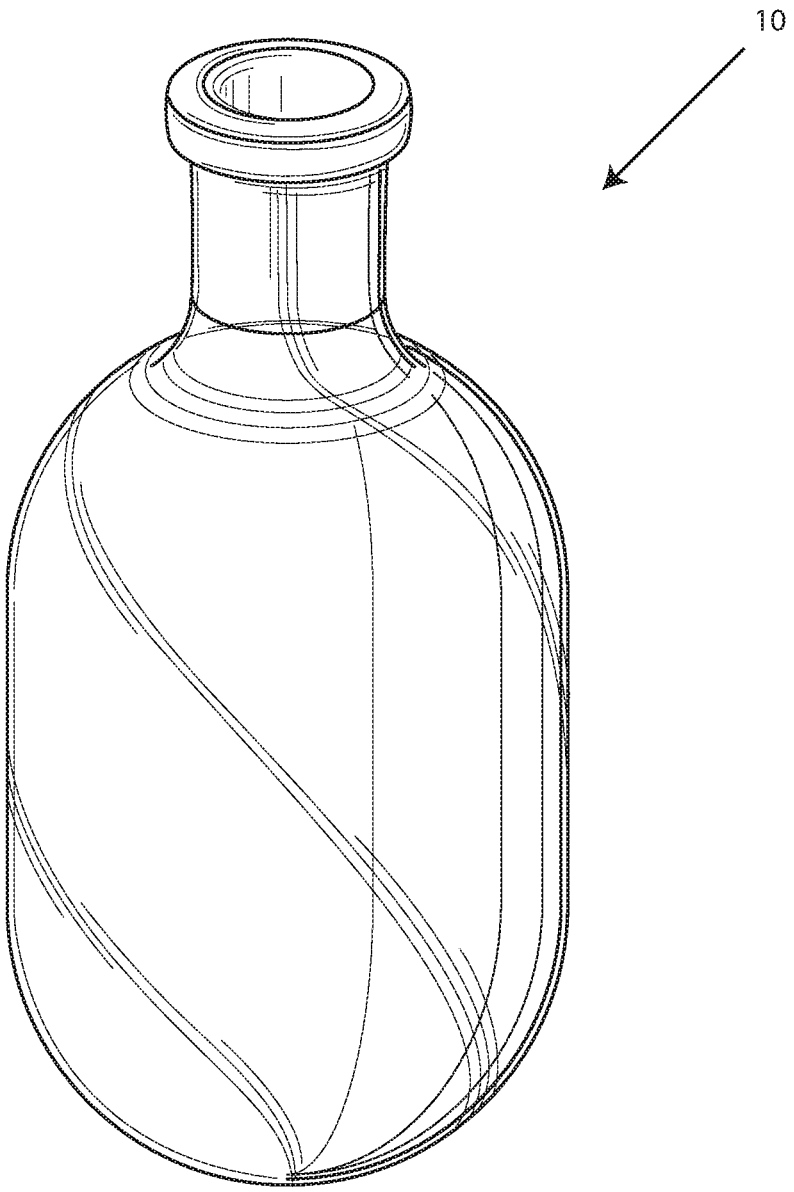

The invention will now be described with reference to the drawings wherein:

FIG. 1 of the drawings is a perspective view of a laboratory flask in accordance with the present invention;

FIG. 2 of the drawings is a side view of the laboratory flask of FIG. 1;

FIG. 3 of the drawings is a top view of the laboratory flask of FIG. 1;

FIG. 4 of the drawings is a cross-sectional view of the laboratory flask taken along line IV of FIG. 3 associated with a laboratory heating block;

FIG. 5 of the drawings is a bottom view of the laboratory flask of FIG. 1; and FIG. 6 of the drawings is a perspective view of an alternative embodiment of a laboratory flask.

DETAILED DESCRIPTION OF THE INVENTION

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-5 in particular, laboratory flask 10 is shown as generally comprising flask body 12, neck 14, and reservoir 16. In accordance with the present invention, reservoir 16 of laboratory flask 10 is adapted for releasable securement within laboratory heating block 17. While laboratory flask 10 is disclosed as being used in association with a laboratory heating block, it will be understood that it may also be used, for example, as a reaction flask without a heating block, heating mantle, oil bath, or the like. Laboratory flask 10 is also suitable for ordinary procedures, such as distillations and/or removal of solvent on, for example, a rotary evaporator.

Laboratory flask 10 substantially reduces and/or eliminates the incidence of accidental spillage of contents contained within flask body 12 if associated with a heating block or heating mantle by preventing tipping to the point of spillage from the open neck of the flask. It will be understood that the term "substantially" with respect to the reduction of the incidence of accidental spillage as used herein, regardless of its ordinary meaning, is defined as a reduction of at least 50%, and more preferably of at least 75%, and yet more preferably of at least 95%. In this embodiment, accidental spillage is reduced primarily because the geometry, size, and/or aspect ratio of reservoir 16 of laboratory flask 10 generally conforms to the geometry, size, and/or aspect ratio of an associated laboratory heating block.

In accordance with the present invention, the laboratory glassware enable the extended use of heating blocks/mantles for large volume reactions. It will be understood that heating blocks and heating mantles are manufactured and marketed with specific sizes of their well or bore, thus restricting or limiting to use to ordinary (e.g., round bottom flasks) sizes and volumes of glassware to the measures of that bore or well, and therefore limiting the size of reactions runnable with it. However, the laboratory glassware of the present invention allow the adaptation of the heating block or mantle with a specific size to larger volume flasks. Typically, a heating block (or heating mantle) that has a well large enough, to accommodate, for example, a round bottom flask with a diameter of about 50 mm and wall thickness of 2 mm, resulting in a reaction volume of maximally about 50 ml. The laboratory glassware of the present invention utilize a wider (e.g., spherical) top part (e.g., diameter of 80 mm), and a lower reservoir of, for example, 50 mm diameter with, e.g., the shape of a half-sphere, contributing a volume of half the sphere with this diameter, has a total volume of about 280 ml, as contrasted to a volume of just about 50 ml with a round bottom spherical flask of diameter of 50 mm that would ordinarily fit this heating block or heating mantle. The usefulness of the heating block is thus greatly extended from 50 ml to about 280 ml (an increase of 460%). It will be understood that other glassware configurations will lead to different changes in usable volume for reactions.

Reservoir 16 of laboratory flask 10 also helps to substantially reduce and/or eliminate sediment rings on the inner surface of flask body 12 that accumulate during traditional agitation. It will be understood that the term "substantial reduction" with respect to sediment as used herein, regardless of its ordinary meaning, is defined as a reduction of at least 25%, and more preferably of at least 50%, and yet more preferably of at least 75%.

By way of comparative example, and to assess the effect of flask shape on effectiveness of agitation, two flasks were compared, namely: (1) a 250 ml round bottom flask of diameter 8 cm; and (2) a cylindrical flask of the same diameter. Both were charged with 150 ml of acetone and 7 g of anhydrous granular sodium sulfate. The same stir bar was used (20 mm length, 6 mm width). The flasks were placed in the same distance of 5 mm to the surface of a magnetic stirring plate which had a display for the speed of rotation. With the round bottom flask it was observed that a sediment ring of sodium sulfate was always present, even at 1200 rpm (maximum speed). Even at low speeds, some solid was propelled into the liquid around the stirring bar, but the sediment ring formed around the rotating stirring bar did not move. The sediment started to be in motion (moving at slow speed in direction of stirring) at about 900 rpm. With increase of speed, more solid was suspended in the liquid. It was estimated that about 25% of the sulfate was still in the sediment ring at 1200 rpm. With the cylindrical flask, it was observed that the sediment ring was already in motion at 550 rpm, and had about the same size as in the round bottom flask at 900 rpm. At 550 rpm there was about the same amount of solid in suspension as in the round bottom flask at 900 rpm. At 1200 rpm there was a very small sediment ring, most sodium sulfate was suspended in the liquid, with an estimate of at most 5% of the sulfate remaining in the sediment ring.

As is best shown in FIG. 4, flask body 12 preferably includes upper portion 18, lower portion 20, and sidewall 22. Sidewall 22 of flask body 12 includes inner surface 24 and outer surface 26. In a preferred embodiment of the present invention, flask body 12 comprises a generally spherical and/or cylindrical sidewall.

Neck 14 preferably includes upper portion 28, lower portion 30, and sidewall 32. Sidewall 32 of neck 14 preferably includes inner surface 34 and outer surface 36. In a preferred embodiment of the present invention, neck 14 comprises a generally cylindrical and/or annular sidewall. Neck 14 also preferably emanates contiguously from flask body 12, and is positioned above the flask body.

Neck 14 also preferably comprises aperture 38 for receiving a stopper, an adapter, a connector, and/or an additional piece of glassware (not shown).

Reservoir 16 preferably includes upper portion 40, lower portion 42, bottom wall 44, and sidewall 46. Sidewall 46 of reservoir 16 preferably includes inner surface 48 and outer surface 50. In accordance with the present invention, reservoir 16 of the laboratory flask is adapted for releasable securement within a laboratory heating block (See FIG. 4).

Reservoir 16 also preferably emanates contiguously from flask body 12, and is positioned below the flask body.

In a preferred embodiment of the present invention, bottom wall 44 of reservoir 16 is planar and/or non-planar (e.g., rounded).

In another preferred embodiment of the present invention, sidewall 46 of reservoir 16 comprises a diameter that is slightly less (e.g., 0.5%, 1%, 2%, 5%) than the diameter of the sidewall of associated laboratory heating block 17 (See FIG. 4).

In yet another preferred embodiment of the present invention, sidewall 46 and bottom wall 44 of reservoir 16 comprise an outer peripheral geometry that is slightly less (e.g., 0.5%, 1%, 2%, 5%) than the corresponding sidewall and bottom wall of associated laboratory heating block 17 (See FIG. 4). In this embodiment, the laboratory glassware of the present invention facilitates efficient heat transfer from a laboratory heating block.

In one embodiment of the present invention, laboratory flask 10 is preferably fabricated from a unitary piece of glass, such as, but not limited to, soda-lime glass, lead glass, borosilicate glass, aluminosilicate glass, silica glass, and fused silica glass—just to name a few. However, other materials are likewise contemplated for use, including, but not limited to, polyethylene, polytetrafluoroethylene or fluorinated ethylene-propylene polymer (FEP), quartz, metal, metal alloys, etcetera.

It will be understood that either a portion of or the entire inner and/or outer surfaces of laboratory flask 10 may be chemically and/or mechanically etched.

It will be further understood that at least a portion of the inner surfaces of laboratory flask 10 may be intentionally scarred and/or scratched to facilitate crystal formation during normal use.

In operation, the present invention is directed to, a process for using laboratory flask 10 with laboratory heating block 17 (See FIG. 4), comprising the steps of: (a) providing a laboratory heating block; (b) providing a laboratory flask as disclosed herein; (c) associating the laboratory flask with the laboratory heating block; and (d) preventing the laboratory flask from substantially tilting relative to the laboratory heating block. It will be understood that the term "substantially" with respect to tilting as used herein, regardless of its ordinary meaning, is defined as a degree and/or amount sufficient to reduce the incidence of accidental spillage of contents contained within the laboratory glassware by at least 50%, and more preferably by at least 75%, and yet more preferably by at least 95%.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein, have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A laboratory flask for use in association with a laboratory heating block, consisting of:

a flask body, wherein the flask body includes an upper portion, a lower portion, and a rounded sidewall, wherein the sidewall of the flask body includes an inner surface, an inner diameter, an outer surface;

a neck positioned above the flask body, wherein the neck includes an aperture, an upper portion, a lower portion, and a linear sidewall, wherein the sidewall of the neck includes an inner surface, an inner diameter, an outer surface; and a reservoir positioned below the flask body, wherein the reservoir includes an upper portion, a lower portion, a bottom wall, and a sidewall, wherein the sidewall of the reservoir includes an inner surface, an inner diameter, and an outer surface, and wherein the reservoir is adapted for releasable securement within a laboratory heating block, and wherein the inner diameter of the flask body is greater than the inner diameter of the reservoir, and wherein the inner diameter of the reservoir is greater than the inner diameter of the neck, and wherein the bottom wall of the reservoir is non-planar.

2. A process for using a laboratory flask with a laboratory heating block, consisting of the steps of:

providing a laboratory heating block;

providing a laboratory flask, consisting of:

a flask body, wherein the flask body includes an upper portion, a lower portion, and a sidewall, wherein the sidewall of the flask body includes an inner surface, an inner diameter, and an outer surface;

a neck, wherein the neck includes an upper portion, a lower portion, and a sidewall, wherein the sidewall of the neck includes an inner surface, an inner diameter, and an outer surface, and wherein the neck emanates contiguously from the flask body; and a reservoir, wherein the reservoir includes an upper portion, a lower portion, a bottom wall, and a sidewall, wherein the sidewall of the reservoir includes an inner surface, an inner diameter, and an outer surface, and wherein the reservoir is adapted for releasable securement within a laboratory heating block, and wherein the inner diameter of the flask body is greater than the inner diameter of the reservoir, and wherein the inner diameter of the reservoir is greater than the inner diameter of the neck, and wherein the bottom wall of the reservoir is non-planar;

associating the laboratory flask with the laboratory heating block; and preventing the laboratory flask from substantially tilting relative to the laboratory heating block.

* * * * *